US005392916A

United States Patent [19]

Paulison

[11] Patent Number: 5,392,916

[45] Date of Patent: Feb. 28, 1995

[54] STACKABLE COMPARTMENTED TRASH RECEPTACLE

[76] Inventor: James H. Paulison, 9535 Tomahawk Blvd., Omaha, Nebr. 68134

[21] Appl. No.: 15,478

[22] Filed: Feb. 9, 1993

Related U.S. Application Data

[62] Division of Ser. No. 576,855, Sep. 4, 1990, Pat. No. 5,184,744.

[51] Int. Cl.[6] ..... B65F 1/06

[52] U.S. Cl. ..... 206/518; 206/515; 220/414; 220/909; 220/446; 220/524

[58] Field of Search ..... 206/515, 518, 520, 519; 220/23.6, 404, 403, 909, 420, 425, 445, 446, 23.4, 23.83, 23.86, 507, 524, 553, 555, 908

[56] References Cited

U.S. PATENT DOCUMENTS

| | | | |
|---|---|---|---|
| 3,916,816 | 11/1975 | Fitch | 206/519 |
| 4,202,460 | 5/1980 | Imbeault | 220/23.4 |
| 4,207,979 | 6/1980 | Brown | 206/518 |
| 4,350,274 | 9/1982 | Morgan | 220/555 |
| 4,428,493 | 1/1984 | McDonough | 206/518 |
| 4,729,489 | 3/1988 | Papaianni | 220/404 |
| 4,856,647 | 8/1989 | Dahne | 220/23.83 |
| 5,007,552 | 4/1991 | Sage et al. | 220/23.4 |
| 5,050,755 | 9/1991 | Strawder | 220/909 |
| 5,062,540 | 11/1991 | Jenkins | 220/23.4 |
| 5,076,462 | 12/1991 | Perrone | 220/909 |
| 5,184,744 | 2/1993 | Paulison | 220/909 |

*Primary Examiner*—S. Castellano
*Attorney, Agent, or Firm*—John A. Beehner

[57] ABSTRACT

An add-on compartment for a trash receptacle includes a open topped material receiving compartment having spaced apart front and back panels protruding transversely outwardly from one side of the compartment for receiving a trash receptacle between them. The panels extend outwardly sufficiently to overlie the walls of the trash receptacles so that the combination compartment and receptacle give the appearance of a unitary structure. A trash bag retaining lip is formed on the upper edge of the compartment and a depending skirt may be provided to cover at least the front wall and outer most side wall of the compartment to provide a smooth continuous appearance with the front panel and a trash receptacle to be received between the panels.

3 Claims, 3 Drawing Sheets

STACKABLE COMPARTMENTED TRASH RECEPTACLE

CROSS REFERENCE TO RELATED APPLICATION

This is a division of patent application Ser. No. 07/576/855 filed on Sep. 4, 1990, now U.S. Pat. No. 5,184,744.

BACKGROUND OF THE INVENTION

The present invention is directed generally to an add-on compartment for trash receptacles and more particularly to such a compartment which affords a fully self-supporting receptacle for an additional trash bag, yet which coacts with the trash receptacle to give the appearance from at least the front side that the combination is a unitary structure.

The environmental interest, and in fact, requirement for sorting of refuse in many communities practically necessitates that a household maintains separate receptacles for cans and perhaps glass and other refuse to eliminate the need for sorting prior to pick-up by a refuse collection service in homes, in particular, it is important that the trash receptacle have a pleasing appearance, so as not to detract from the decor of the kitchen or other room in which it is placed. Relatively attractive plastic individual trash receptacles are commercially available. An arrangement of several unconnected trash receptacles in side-by-side relation detracts from their aesthetic appearance, however, particularly if they become displaced from one another during use and misaligned.

Whereas multiple trash bags may be inserted into a single trash receptacle, the engaged and unsupported sides of the trash bags tend to collapse toward the least filled bag making it difficult to fill both and interfering with the removal of either bag.

A single trash receptacle with multiple compartments is disclosed in Papaianni, U.S. Pat. No. 4,729,489, but that device gives the appearance of a cluster of individual trash receptacles which a homeowner will likely prefer to hide rather than set out where it is readily accessible. Furthermore, the Papaianni container is used to replace existing receptacles, rather than extend and improve their useful like.

It is furthermore desirable that receptacles of possibly foul smelling trash not be opened any more frequently than is required for adding trash to that particular receptacle.

Accordingly, a primary object of the invention is to provide an add-on compartment for a trash receptacle.

Another object is to provide an improved multi-compartment rash receptacle having the appearance, at least from the front of a unitary structure.

Another object is to provide add-on compartments for a trash receptacle, which compartments are stackable in nested relation for compact storage and transport.

Another object is to provide an add-on compartment for at rash receptacle having a separate cover for that compartment.

Another object is to provide an add-on compartment for a trash receptacle which provides independent support on all four sides for a trash bag inserted therein.

Another object is to provide an add-on compartment for a trash receptacle, which compartment provides a peripheral trash bag retaining lip around the upper edge thereof.

Another object is to provide a trash receptacle add-on compartment which is simple and rugged in construction, economical to manufacture and efficient in operation.

SUMMARY OF THE INVENTION

The add-on compartment for a trash receptacle, according to the invention, includes an open topped material receiving compartment having spaced apart front and back panels protruding transversely outwardly from one side of the compartment for receiving a trash receptacle between the panels. At least the front panel has a transverse extent sufficient to overlie the front wall of a trash receptacle over at least a substantial portion of the height of the trash receptacle, whereby the front view of the combination compartment and trash receptacle gives the appearance of a unitary structure.

The add-on compartment is preferably provided with a trash bag retaining lip around the top edge thereof for securely supporting a flexible trash bag therein. The add-on compartment may further include a depending skirt covering at least a substantial portion of the front wall and outermost side wall, with at least the front panel being a transverse extension of the skirt. The skirt is preferably spaced from the adjacent walls of the compartment so as to accommodate the insertion of the open top of a second add-on compartment therein so that several add-on compartments may be stacked in nested relation for compact storage and transport.

The invention is, furthermore, directed to a multi-compartment trash receptacle including first and second material receiving compartments, each having a peripheral trash bag retaining lip adjacent the top edge thereof and peripheral skirt connected to and at least partially surrounding both compartments to provide at least a front view appearance of a unitary structure. The skirt of the multi-compartment trash receptacle is likewise spaced from the adjacent walls of the compartments thereof so that several of the multi-compartment trash receptacles may be stacked in nested relation for compact storage in transport. It is preferred that the skirt extend continuously across the front and outer most walls of the trash receptacle. A ledge preferably interconnects the adjacent compartments to maintain them in fixed spaced relation from one another and to block the fall of refuse into any unaccessible space between the compartments.

DESCRIPTION OF THE PREFERRED EMBODIMENT

Figure 1:
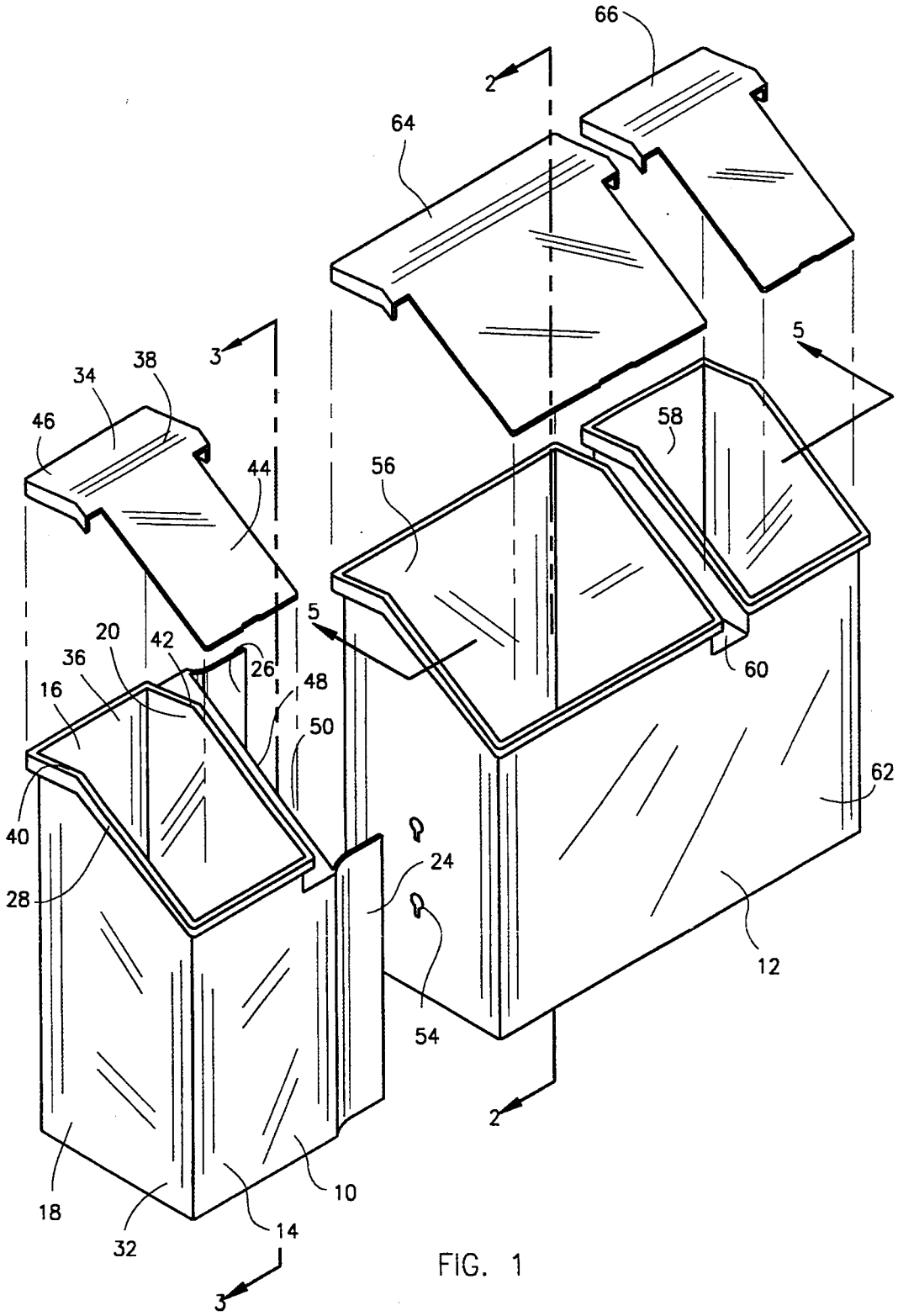
FIG. 1 is an exploded perspective view of the add-on compartment of the invention positioned for receiving the multi-compartment trash receptacle of the invention between the spaced panels thereof.

An add-on compartment 10 for either a conventional single compartment trash receptacle or the multi-compartment trash receptacle 12 of the invention, is illustrated in the drawings as including a front wall 14, back wall 16, opposite transversely spaced apart side walls 18 and 20 and a bottom 22. The bottom and walls are connected together to define the open topped material receiving compartment 10.

Add-on compartment 10 additionally includes spaced apart front and back panels 24 and 26 which protrude generally transversely outwardly from one side 20 of the compartment for receiving a trash receptacle between them. At least the front panel 24 has a transverse extent sufficient to overlie the front of a trash receptacle received between the panels so that the combination add-on compartment and trash receptacle has the appearance of a unitary structure. It is preferred that the front and back panels 24 and 26 extend outwardly from compartment 10 over at least a substantial portion of the height of the front and back walls 14 and 16 of the compartment.

A trash bag retaining lip 28 extends outwardly and downward from the compartment walls adjacent the top edge thereof so that the top of a flexible trash bag inserted into the compartment may be wrapped around the lip to support the bag and prevent it from collapsing into the compartment. The lip preferably cooperates with the compartment walls to define a partially open bottomed channel 30 around the top periphery of the compartment.

Figure 3:
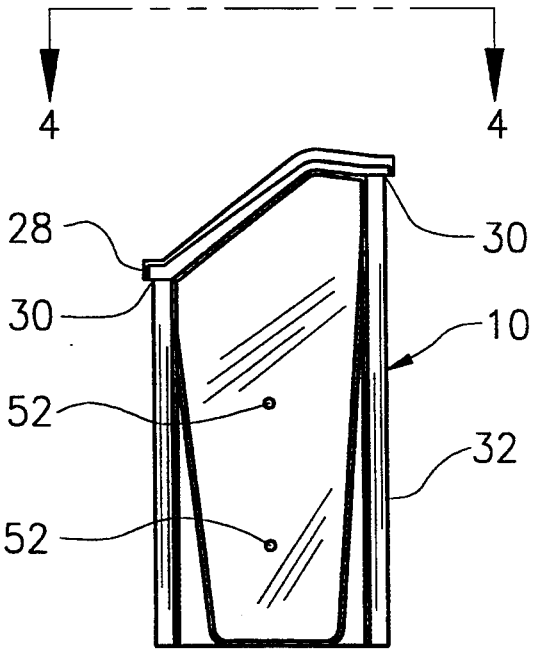
FIG. 3 is a side sectional view of the add-on compartment of the invention taken along line 3—3 in FIG. 1.

Additional strength and an aesthetic appearance for the compartment is provided by a depending skirt 32 which is operatively connected to the compartment walls adjacent lip 28. As illustrated in FIG. 3, lip 28 may include an inward extension 33 from which the skirt 32 depends as an integral downward extension of lip 28. The skirt preferably covers at least a substantial portion of the front wall 14 and outer most side wall 18 of the compartment, extending downwardly sufficient for engagement with the same support surface on which the compartment rests.

Figure 5:
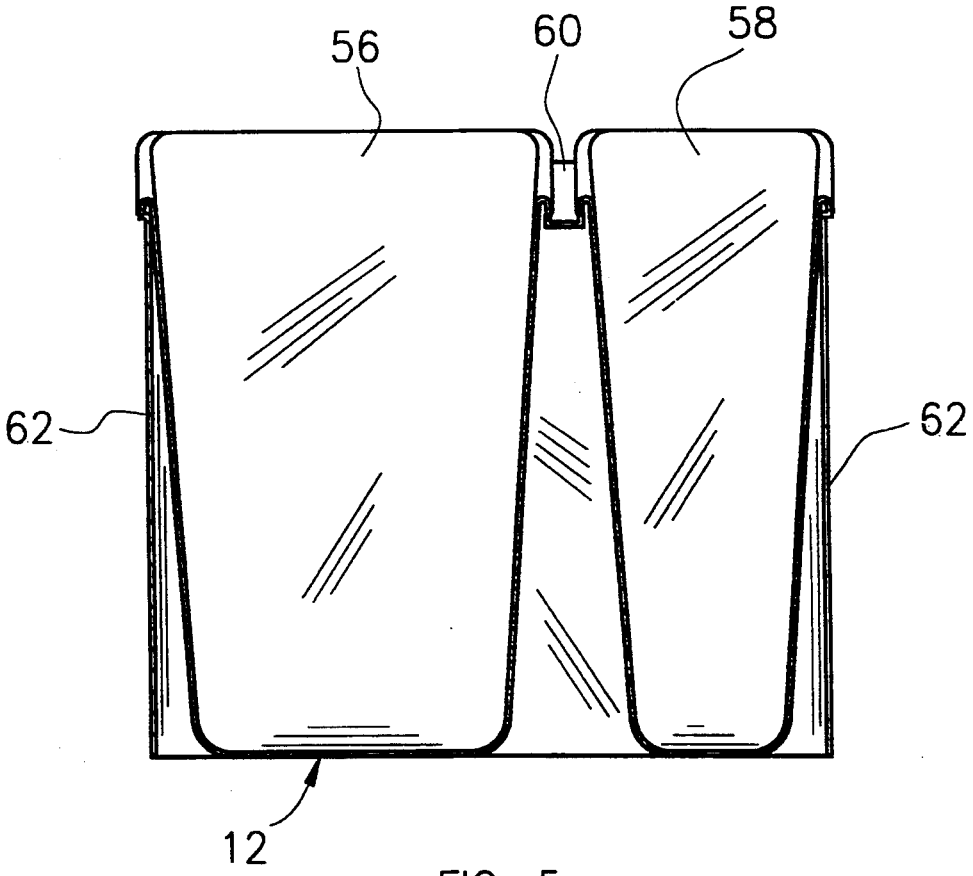
FIG. 5 is a front sectional view of the multi-compartment trash receptacle of the invention, taken along line 5—5 in FIG. 1.

The front and back panels 24 and 26 may thus be formed integral transverse extensions of the skirt 32 for a clean simple visual appearance. The front and back panels may be constructed substantially as mirror images of one another if that construction accommodates the type of receptacle to be received between them. As shown in FIG. 5, the panels may tend to converge outwardly and toward one another prior to insertion of a trash receptacle between them to facilitate engagement of the panels against a trash receptacle along substantially the full height of the panels.

Figure 6:
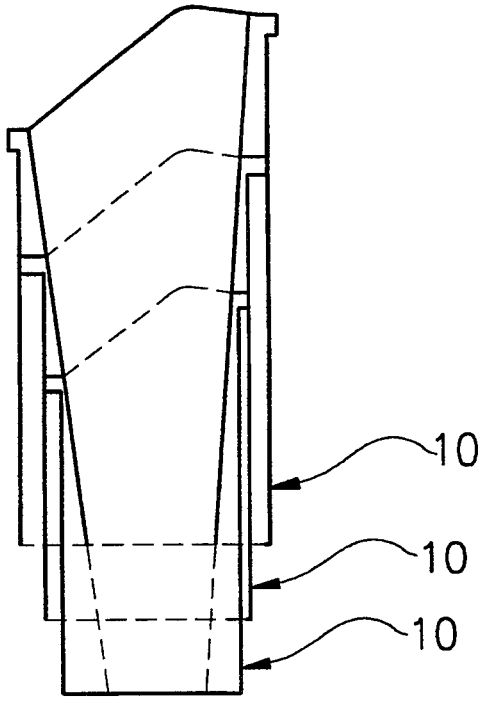
FIG. 6 is a diagrammatic side sectional view showing a plurality of the add-on compartments stacked in nested relation.

Referring to FIGS. 3 and 6, skirt 32 is horizontally spaced from the front wall 14, back wall 16 and side wall 18 sufficiently to accommodate insertion of the open top of a second add-on compartment 10 therebetween so that several of the add-on compartments 10 may be stacked in nested relation for compact storage and transport. For this purpose, the surfaces of skirt 32 should flair slightly downwardly and outwardly to accommodate receipt of the slightly wider lip of a next lower compartment 10 onto which a compartment is to be stacked. It is helpful to minimize the outward extent of lip 28 beyond the top of skirt 32 while maintaining sufficient clearance between them for engaging a trash bag around the lip.

Since the receptacle that is to be received between the outstretched panels of the add-on compartment 10 likely has its own separate cover, the add-on compartment 10 is preferably provided with a compartment lid or cover 34 which is pivotally connected to the compartment for pivotal movement between a closed position substantially closing the open top of a compartment and an open position enabling the insertion of materials into the compartment through the top opening 36. Lid 34 has a somewhat inverted V-shape so as to present an apex 38 which rocks on the apices 40 and 42 of side walls 18 and 20.

Accordingly, when the front portion 44 of lid 34 is depressed by dropping refuse against it, the lid rocks on apex 34 with front portion 44 being depressed into the compartment. Once the refuse has cleared front portion 44, it returns upwardly to its closed position due to the greater weight the rearward portion 46 of the lid.

A ledge 48 may be formed between front and back panels 24 and 26 adjacent the upper edges thereof to engage a trash receptacle inserted between the panels and properly space it from the add-on compartment. Ledge 48 may simply be a plate engaging compartment side wall 20 and secured at both ends to the panels. When a trash receptacle is engaged against the free edge of the ledge, the ledge additionally serves to block the entry of trash into any unaccessible space 50 between the receptacle and compartment Add-on compartment 10 may additionally be provided with coacting fasteners such as the headed pins 52, shown in FIG. 3, for insertion into the registered keyhole shaped openings 54 in the side wall of a receptacle as illustrated in FIG. 1. Upon insertion of the pins 52 into the keyhole openings 54 and downward movement of the compartment Z0 to seat the pins therein, the compartment 10 is securely but removably mechanically locked to the receptacle .

Figure 2:
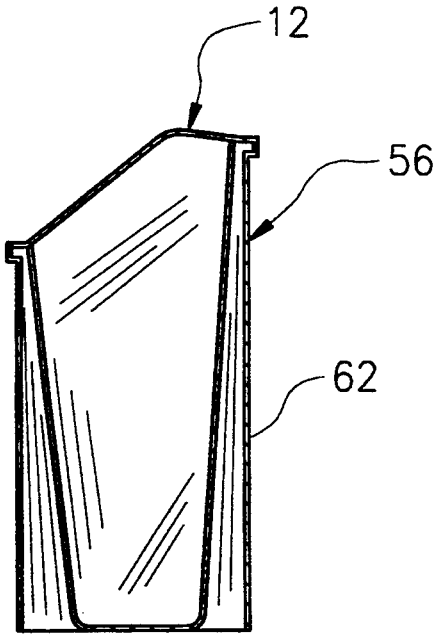
FIG. 2 is a side sectional view of the multi-compartment trash receptacle, taken along line 2—2 in FIG. 1.
Figure 4:
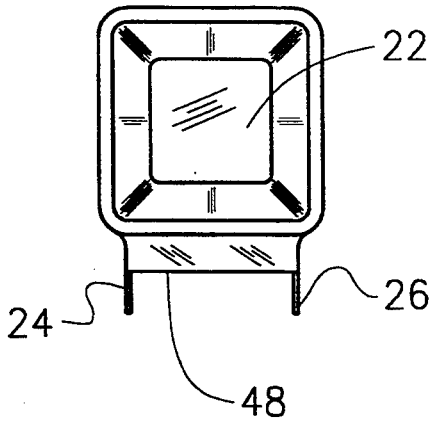
FIG. 4 is a top plan view of the add-on compartment of the invention.

Whereas the add-on compartment 10 of the invention is designed for use in conjunction with existing trash receptacles which home owners may already have, the invention is furthermore directed to the multi-compartment trash receptacle 12, illustrated in FIGS. 1 2, and 7, which includes separate first and second compartments and 58 similar to compartment 10 but interconnected by a transverse ledge 60 and a single depending skirt 62 surrounding both compartments. Separate covers 64 and 66 are provided for the respective compartments. The previously described keyhole shaped openings 54 may be formed in one side of skirt 62 for mechanical connection to the add-on compartment 10. The skirt 6Z for multi-compartment trash receptacle 12 is spaced from the walls of the first and second compartments 56 and 58 similarly as illustrated in connection with add-on compartment 10 so that several receptacles 12 may be stacked in nested relation for compact storage and transport.

Whereas the invention has been shown and described in connection with preferred embodiments thereof, it is apparent that many modifications, additions and substitutions may be made which are within the intended broad scope of the appended claims.

I claim:

1. A multi-compartment trash receptacle comprising, first and second spaced apart material receiving compartments, each compartment including front, back, and opposite side walls and a bottom connected to said side walls, each compartment further comprising a trash bag retaining lip extending outwardly and downwardly from said front, back and opposite side walls adjacent a top edge of each compartment, a peripheral skirt operatively connected to both compartments at a position adjacent said top edges thereof and extended downwardly therefrom substantially to the level of said bottom for connecting said first and second compartments giving a front view appearance of a unitary structure, and said skirt being spaced from said front, back and opposite walls of said compartments so as to accommodate insertion of an open top of a second similarly configured trash receptacle therebetween, so that a plurality of said trash receptacles can be stacked in nested relation for storage and transport.

2. The multi-compartment trash receptacle of claim 1 wherein said peripheral skirt extends substantially continuously across the height and transverse extent of the front walls and outermost side walls of said compartments.

3. The multi-compartment trash receptacle of claim 2 further comprising a ledge connected to and extended between the adjacent side walls of said first and second compartments at a position adjacent to but spaced below the trash bag retaining lips of the respective compartments.

* * * * *